US012339093B1

(12) United States Patent
Harmer

(10) Patent No.: US 12,339,093 B1
(45) Date of Patent: Jun. 24, 2025

(54) RECOIL PAD ASSEMBLY

(71) Applicant: Backfire LLC, St. George, UT (US)

(72) Inventor: James Elden Harmer, St. George, UT (US)

( * ) Notice: Subject to any disclaimer, the term of this patent is extended or adjusted under 35 U.S.C. 154(b) by 0 days.

(21) Appl. No.: 18/389,804

(22) Filed: Dec. 20, 2023

(51) Int. Cl.
*F41C 23/08* (2006.01)

(52) U.S. Cl.
CPC ..... *F41C 23/08* (2013.01)

(58) Field of Classification Search
CPC ..... F41C 23/06; F41C 23/08; F41C 23/18; F41C 23/20
See application file for complete search history.

(56) References Cited

U.S. PATENT DOCUMENTS 1,325,152 A * 12/1919 Hawkins ..... F41C 23/08 42/74
1,642,835 A * 9/1927 Ammann ..... F41C 23/08 42/74
1,729,514 A * 9/1929 Lorimer ..... F41C 23/08 42/74
2,091,010 A * 8/1937 Pachmayr ..... F41C 23/08 42/74
2,320,430 A * 6/1943 Hawkins ..... F41C 23/08 42/74
2,667,005 A * 1/1954 Weis ..... F41C 23/22 42/74
3,007,272 A * 11/1961 Pachmayr ..... F41C 23/08 42/74
3,363,352 A * 1/1968 Pachmayr ..... F41C 23/08 42/74
3,514,889 A * 6/1970 Pachmayr ..... F41C 23/08 42/74
3,665,990 A * 5/1972 Hefner, Jr. ..... F41A 35/02 42/74
4,551,937 A * 11/1985 Seehase ..... F41C 23/08 42/74
5,235,765 A * 8/1993 Chesnut ..... F41C 23/08 42/74
6,543,172 B1 * 4/2003 Armstrong ..... F41C 23/08 42/71.01
9,927,206 B1 * 3/2018 Smith ..... F41C 23/16
11,092,404 B2 8/2021 Bryan
2008/0053850 A1 * 3/2008 Daniel ..... F41C 33/06 206/317
2012/0279108 A1 * 11/2012 Dalton ..... F41C 33/003 42/94
2013/0174461 A1 * 7/2013 Ballard ..... F41C 23/08 42/74
2014/0075801 A1 * 3/2014 Moretti ..... F41C 23/18 42/1.06
2016/0137839 A1 * 5/2016 Rolland ..... C08G 18/4854 522/71

(Continued)

*Primary Examiner* — Gabriel J. Klein
(74) *Attorney, Agent, or Firm* — Nathaniel P. Potter

(57) ABSTRACT

A recoil pad for a firearm including at least two distinct lattice layers wherein at least one of the lattice layers is comprised of a gyroid structure designed to optimize the dissipation, redirection, absorption, and other effect of the felt recoil generated by shooting a firearm, and a protector for the recoil pad to minimize pressure placed on the recoil pad and prevent deformation, misalignment, warping, undesired compression, and damage when the firearm that the recoil pad is coupled with is transported and/or stored without removing the recoil pad.

18 Claims, 8 Drawing Sheets

(56) References Cited

U.S. PATENT DOCUMENTS

| | | | | |
|---|---|---|---|---|
| 2017/0029968 | A1* | 2/2017 | Wadley | G03F 7/0015 |
| 2020/0340778 | A1* | 10/2020 | Bryan | F41C 23/08 |
| 2021/0195995 | A1* | 7/2021 | Sakamoto | A43B 7/32 |
| 2023/0266097 | A1* | 8/2023 | Moretti | F41C 23/18 42/1.06 |
| 2024/0091611 | A1* | 3/2024 | Roach | B33Y 80/00 |

* cited by examiner

RECOIL PAD ASSEMBLY

FIELD OF THE INVENTION

The present invention generally relates to recoil pad assemblies for firearms. More particularly, recoil pad assemblies featuring more than one latticed or lattice-like material structure that is constructed to reduce the recoil felt by a user to improve the user's accuracy, comfort, and view through a scope while operating the firearm, and a protector for the recoil pad assembly.

BACKGROUND OF THE INVENTION

Firearms, particularly shoulder firearms such as rifles and shotguns, are well known for the recoil generated by their shot. This recoil is almost always discharged in the opposite direction to which the firearm is aimed. Said recoil can be anywhere from jarring to painful to the firearm's user (or "shooter"). Recoil pads present one solution to the problems created by firearm recoil.

There are a variety of recoil pads offering different degrees of recoil absorption among other benefits. Typically, recoil pads differ primarily in construction and in material. This construction could be differences in shape, number of layers, distance created between the firearm and the user, and more. Most recoil pads are made of materials such as metals, rubbers, plastics, and leather or cloth.

One common type of recoil pad includes empty spaces that may or may not compress, this group of spaces is sometimes called a "crush zone." The goal of said spaces is to allow compression of the recoil pad into the empty space and/or outward, to reduce the recoil felt by the user when a shot is discharged from the firearm. Often, these recoil pads must overcome the challenges of deformation, developing a movement memory, cracking or damage (in some instances), and loss of functionality over time and through repeated use-particularly when a rifle is stored on the recoil pad and leaned against a wall.

The other most common type of recoil pad includes at least one layer of rubber, foam, springs or similar devices, or similar material in order to provide a compressible pad to absorb some of the recoil generated by the firearm's discharge. These recoil pads are predominantly solid and typically much heavier than their "crush zone"-having counterparts. Further, in addition to the weight, these recoil pads tend to be much stiffer which results in more of the force of the discharge of the firearm being placed on the user.

One problem presented by currently available recoil pads is that they are either made of hard materials because they are usually stored with the recoil pad supporting the weight of the firearm or the recoil pads are too soft causing the recoil pad to deform while supporting the weight of the firearm during storage.

One further problem is that firearms are growing increasingly capable of firing more powerful ammunition. This creates a need for updated and more advanced recoil dispersion solutions.

In short, the recoil pad industry is in dire need of modernization in design, material, and construction of recoil pads. Therefore, there exists a need for a novel solution which supplies users with a recoil pad that is both lightweight and disperses as much recoil as necessary to provide the user significant relief from discharging a firearm. Further, there is a need for a device that allows the storage of lighter weight and softer recoil pads without danger of deformation or damage during storage.

Some of these solutions have become more commercially available over the last decade due to the emergence and increasingly cost-effectiveness of 3-D printing technology. Particularly, the use of lattice and lattice-like structures in modern consumer products are providing lighter apparatuses that have nearly the same, the same, or better structural integrity and force-absorbing properties. Lattice structures were very difficult and/or costly to manufacture through traditional techniques such as injection molding, additive manufacturing without using 3-D printers, and subtractive manufacturing; however, 3-D printing technology has advanced enough to where many consumers could print lattice structures on their home machines. This availability along with the further improvements to the technology (such as printer resolution and resin or filament composition, structure, and availability) has allowed for the innovation and creation of lattices to replace traditional designs, structures, and/or layers in many consumer products. Moreover, the implementation of lattice or lattice-like structures in some consumer products has created a new need for a protection and storage solution for those structures.

SUMMARY OF THE INVENTION

The following presents a simplified summary of the present invention to provide a basic understanding of the invention's concepts. This summary is not an extensive overview, and it is not intended to identify critical elements or to limit the scope of this disclosure. The sole purpose of this summary is to present some general concepts in a simplified form as a prelude to the detailed description of the invention. The subject matter disclosed and claimed herein, in some embodiments of the present invention, relates to a recoil pad comprising: a bottom layer that engages with the firearm to secure the recoil pad to the firearm via a firearm coupling means; at least two lattice layers comprising: a first lattice layer connected to the bottom layer and comprising a first lattice structure; a second lattice layer connected to the first lattice layer and comprising a second lattice structure that is different from the first lattice layer; wherein the layer of lattice structure furthest from the firearm serves as a final lattice layer; a top layer connected to the final lattice layer; wherein the at least two lattice layers are designed and constructed to dissipate, redirect, absorb, and effect the felt recoil generated by the firearm when a user shoots the firearm; and the firearm coupling means for attaching the recoil pad to the firearm; and a protector that is designed to form fit the recoil pad to protect the recoil pad from deformation, misalignment, warping, undesired compression, and damage while the firearm the recoil pad is coupled with is being transported and stored without removing the recoil pad.

To the accomplishment of the foregoing and related ends, certain illustrative aspects of the disclosed innovation are described herein in connection with the following description and the annexed drawings. These aspects are indicative of only a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The embodiments of the present invention disclosed herein are illustrated by way of example, and not by way of limitation, in the figures of the accompanying drawings, in which like reference numerals may refer to similar elements.

DETAILED DESCRIPTION OF THE PRESENT INVENTION

Figure 1:
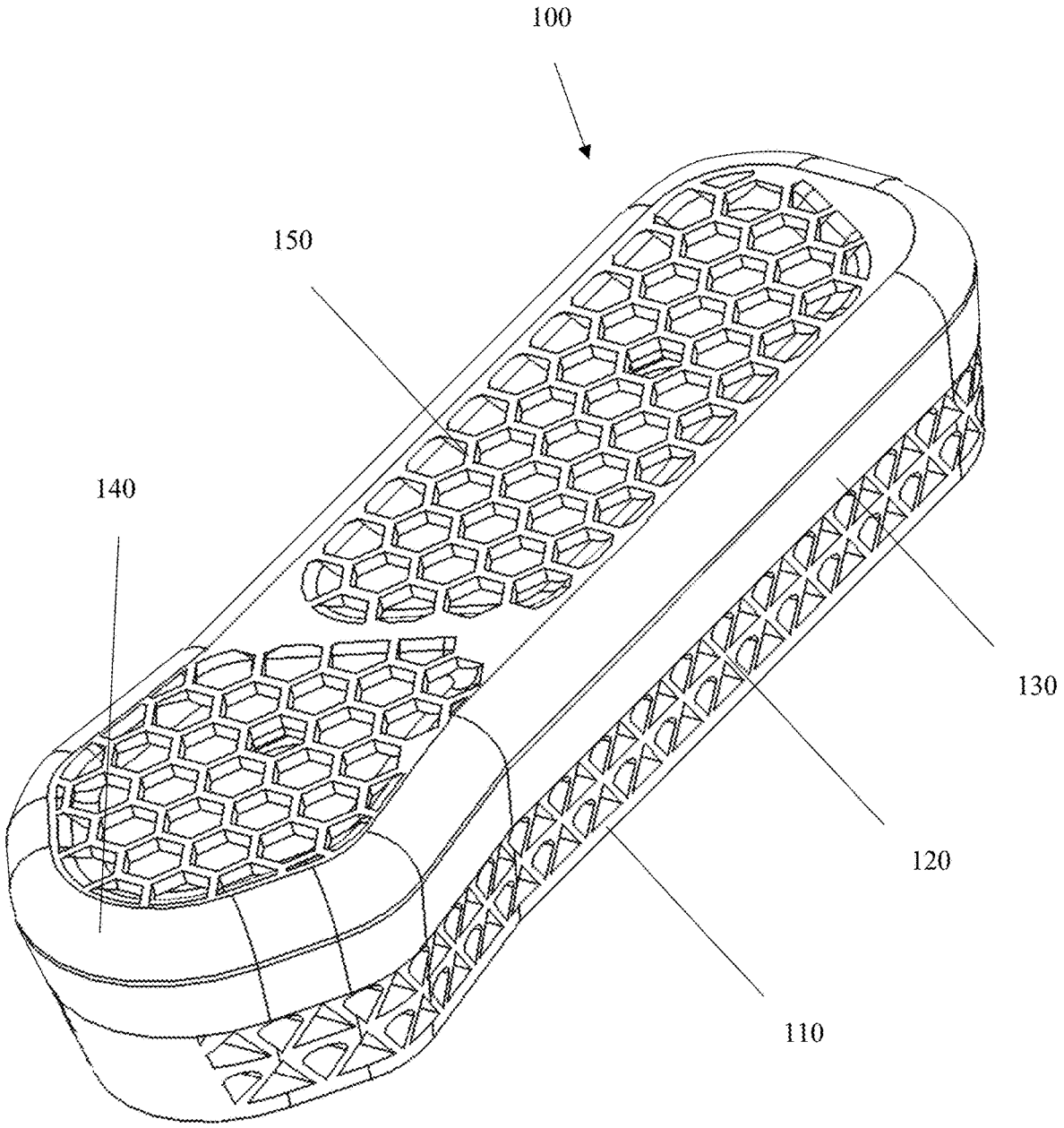
FIG. 1 depicts a top isometric view of an exemplary embodiment of a recoil pad having two distinct lattice layers for optimizing the reduction of felt recoil created by discharging an attached firearm.

The innovation is now described with reference to the drawings, wherein reference numerals are used to refer to elements throughout. In the following description, for purposes of explanation, numerous specific details are set forth to provide a thorough understanding of the present invention. It may be evident that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

The recoil generated by discharging a firearm is often represented by a graph having a pressure axis and a time axis. Most firearms generate a curve that is parabolic with a steeper incline than decline. This means that the pressure generated by firing a firearm builds extremely fast, peaks, and then tapers off fast initially but slower as time goes on. Various graphs depicting recoil patterns almost uniformly show a near-instant incline then a more gradual or "stairstep" dropoff in pressure over time as the recoil generated by discharging a firearm has a few separate stages of applied pressure unique to the type of firearm, the type of ammunition, whether a silencer or other attachment is being used, and more. These different forms of pressure over time graph demonstrate the need to potentially customize a recoil pad to the firearm, ammunition, and other factors.

This variance in pressure and pressure-over-time creates a dynamic where some materials and structures are better at dispersing, distributing, and/or discharging the recoil generated by firing a firearm at different points on the graph. Therefore, a recoil pad designed to optimize the handling of more than one type of pressure event and pressure-over-time provides more benefit to the user or shooter than traditional recoil pads.

As previously mentioned, recoil pad technology has remained mostly unchanged for the last couple decades. Any improvements that have been made typically result in a recoil pad that is not designed for a variety of firearms due to size, materials, composition, construction, and technology. Further, most commercial recoil pads include dense and heavy materials instead of allowing design and lighter materials to be used to maximize dispersion of recoil while minimizing the impact on barrel movement and force applied to the user. Therefore, there exists a need for a modern recoil pad that is comparatively lite and better disperses, distributes, and/or discharges the felt recoil generated by firing the firearm.

As a note, "reduction of recoil" as used in the present application focuses on the reduction of felt recoil. Specifically, recoil felt by the user/shooter and, potentially, the recoil exerted on the firearm. Further, "reduction of recoil" may be understood to mean "slowing the velocity of the rifle's recoil" or otherwise reducing the maximum pressure exerted at one instance on the user by the discharge of a firearm (possibly by lengthening the time in which the pressure is exerted, redistributing the pressure away from and/or in a different direction than the recoil pad's contact point(s) with the user, etc.).

FIG. 1 depicts a top isometric view of an exemplary embodiment of a recoil pad having two distinct lattice layers for optimizing the reduction of felt recoil created by discharging an attached firearm. In some embodiments, a recoil pad 100 comprises a bottom layer 110, at least two lattice or lattice-like layers such as a first lattice layer 120 and a second lattice layer 130 (hidden in FIG. 1 by an exterior support structure), a stabilizing covering 140, and a top layer 150. The recoil pad 100 should be designed and constructed in a manner such that the force generated by discharging the firearm (to which the recoil pad 100 is attached) is as equally dispersed as possible among the area of a user's body or shooter's body which engages the recoil pad 100. The recoil pad 100 may be made of one or more materials including rubber, metal, leather, plastic (including resins), and other suitable materials which may be used to construct a pad capable withstanding the force generated by a firearm and dispersing, distributing, and/or discharging that force in a way such that the user or shooter experiences and/or feels a reduced force compared to the absolute output of the firearm's recoil.

In some embodiments, the first lattice layer 120 and the second lattice layer 130 are constructed as traditional lattices; however, in alternative embodiments, at least one lattice layer within the recoil pad 100 may be a constructed as a modified lattice structure or a lattice-like structure having nearly identical or further beneficial properties to the lattice layer(s). These modified lattice structures or lattice-like structures may include improvements to the design of the structure to make the structures better perform the task of absorbing, redirecting, redistributing, and/or disbursing the recoil generated by the firearm or for design and/or manufacturing considerations. For example, a modified lattice layer or lattice-like layer primarily constructed of triangular shapes may include modifications such as curved or supported intersections or corners which provide additional support in the absorption of the firearm's recoil. Further, in the exemplary triangular shaped modified lattice or lattice-like structure, not all triangles may have identical shapes or number and/or types of supports. Namely, the triangles near the bottom layer 110, the top layer 150, and/or another lattice layer may be modified to have wider bases, rounded exteriors, and/or additional supports for design, manufacture, or utility reasons. Further, lattice-like structures and modified lattice structures may be modified to include pieces that do not interlace or weave together and/or are modified in order to fit the space available and shape within their layer within the recoil pad 100.

For the sake of condensing the explanations in this disclosure, lattice structures, lattice-like structures, and modified lattice structures may be collectively called "lattice structures" because they will all have similar composition, design, manufacture, and/or function. "Lattice structures" also includes lattice and lattice-like structures featuring beams, plates, triply periodic minimal surface ("TPMS") lattices, homogeneous and heterogeneous lattices, and stochastic components among other options suited to be used in the present invention. Further, lattice-like structures and modified lattice structures include structures which do not necessarily interweave but include repeating shapes and/or patterns that have desirable properties such as the capability of dispersing, distributing, redirecting, absorbing, diffusing and/or discharging the recoil produced by the firearm.

Finally, lattice structures may be slightly modified to fit and better function within any lattice layer within the present invention. For example, it may be necessary (due to functional, manufacturing, design, or other reasons) to modify the exterior of the lattice structure to provide integrity to the lattice layer and for the lattice structure to fit and best function within its layer within the present invention.

The recoil pad 100 includes, in some embodiments, the bottom layer 110 which is designed to engage with the firearm. Further, the bottom layer 110 may be constructed of the same or different material than other portions of the recoil pad 100. This allows the bottom layer 110 to be constructed of harder material (such as carbon-fiber reinforced nylon) which may be better suited for handling certain pressure events that occur when firing the firearm. The position of harder materials, such as metals, plastics, or nylons, on the bottom layer 110 provides the benefit of the recoil absorption properties of said harder materials without placing those harder materials in contact with the user. For example, instead of having the hard material engage the user's body when firing, the hardened portion of the recoil pad 100 may be placed on the portion of the recoil pad 100 that engages the firearm. This is beneficial because the harder material is likely to have a harsher and/or stronger impact on the user when discharging the firearm.

The bottom layer 110 is connected to the first lattice layer 120 and may serve as a base for the first lattice layer 120 to be applied to, constructed on, etc. The first lattice layer 120 may be connected to the second lattice layer 130 either directly or via an intermediate layer (not pictured) which may provide added support and recoil absorption. Importantly, the first lattice layer 120 and the second lattice layer 130 are made of two different lattice structures and also possibly made of different materials.

The lattice layers may be 3-D printed using filament, plastic, elastomer, polymer, resin, or other suitable materials which provides lightweight yet sturdy support with resistance to compression and dissipation of force (such as a firearm's recoil). With such construction methods, filament or other wall thickness of the lattice structures ranging from about 0.2 mm to about 2 mm produce various mixes of recoil absorption, resistance to deformation, and the lightest weight. Pore size is also a concern when dealing with the durability and compression efficiency of a lattice structure. Particularly, poke sizes ranging from about 1 mm to about 5 mm provide effective lattice structures for absorbing the recoil from a firearm within the present invention. Lattice structures having gyroids may need to limit the size of their structure. Ideally, the gyroid structure repeats between about 1.5 mm and 1.7 mm in order to provide efficient felt recoil reduction to the user.

Above the second lattice layer 130 and the exterior support structure is the stabilizing covering 140 which provides some recoil absorption and structural integrity to the recoil pad 100. The stabilizing covering 140 should be made of materials that are relatively elastic or somewhat softer compared to other parts of the recoil pad 100 because the stabilizing covering 140 contacts the user during operation of the firearm. The stabilizing covering 140 may also connect to the top layer 150 which may both include structures to both disperse, distribute, redirect, absorb, diffuse and/or discharge the recoil produced by the firearm. The top layer 150 also contacts the user during operation of the firearm and may be covered by a thin layer of the same or a different material which may further include a durable design and/or textured surface. In embodiments including two or more lattice layers, the last (or nth) layer of lattice may serve as a final lattice layer which also connects to the top layer 150. Put another way, the final lattice layer is the further lattice structure from the firearm.

The recoil pad 100 may be assembled from separated 3-D printed, created, or manufactured parts or it may be comprised of one process (3-D print, manufacture, injection mold, etc.).

Figure 2:
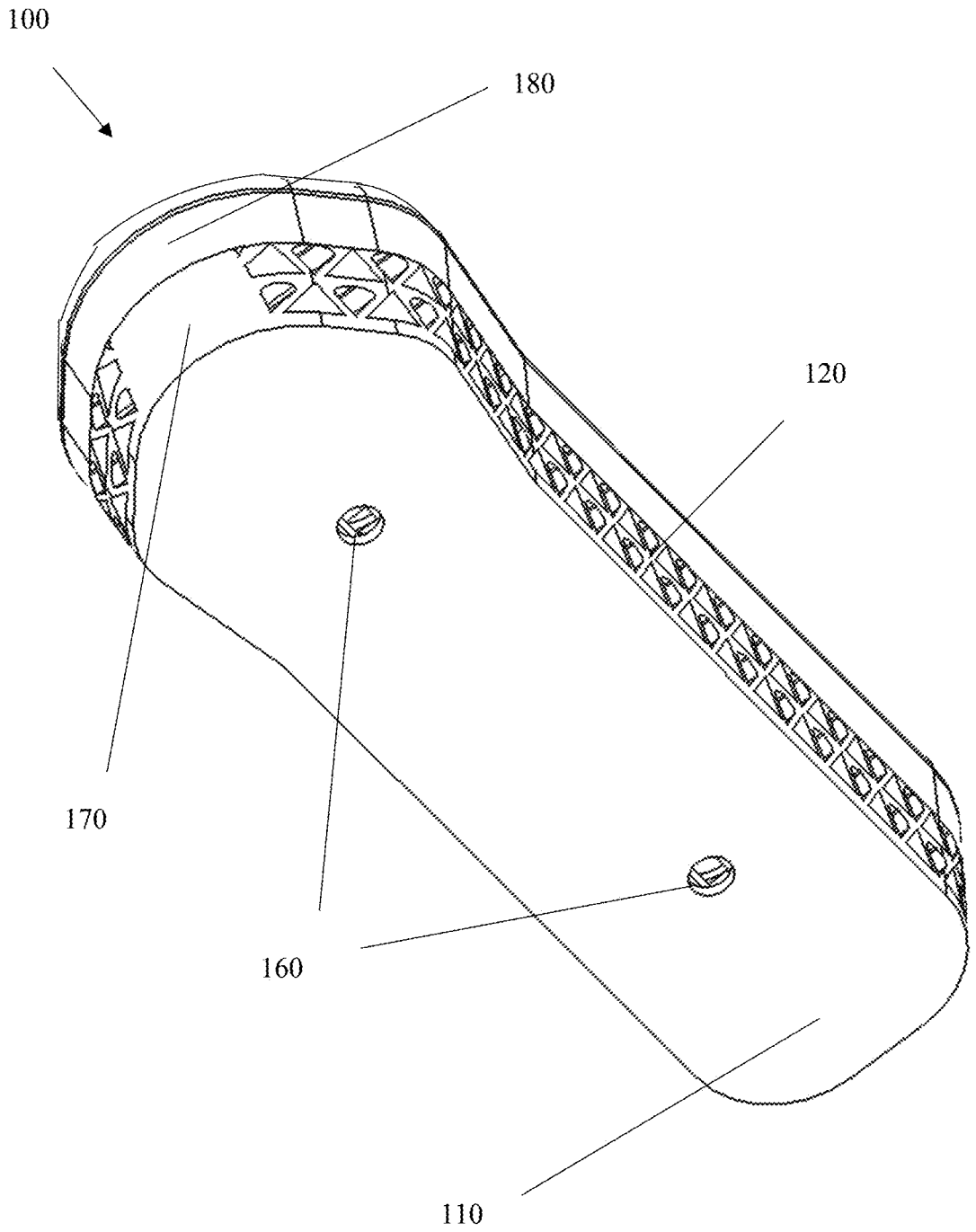
FIG. 2 depicts a bottom isometric view of an exemplary embodiment of a recoil pad having two distinct lattices for optimizing the absorption of recoil created by discharging an attached firearm.

FIG. 2 depicts a bottom isometric view of an exemplary embodiment of a recoil pad having two distinct lattices for optimizing the absorption of recoil created by discharging an attached firearm.

In some embodiments, the bottom layer 110 will most often feature a firearm coupling means 160 which is depicted as a set of holes (which would further include accompanying fasteners such as screws or bolts) to allow the user to secure the recoil pad 100 to the firearm. In this embodiment, the holes comprising the firearm coupling means 160 go through the entire height of the recoil pad so that the screws may be inserted through the top layer 150 and come out the bottom layer 110 to secure the recoil pad 110 to the firearm. In alternative embodiments, firearm coupling means 160 may include adhesive layers (including glues and other adhesives), mechanical engagement mechanisms, hook and loop connectors, straps, and other suited means which allows the recoil pad to engage the firearm and not be unattached during operation of the firearm.

At least one stabilization piece 170 may be included in the design and construction of the recoil pad 100 featuring two lattice layers. Stabilization pieces 170 may be comprised of the same or different material than the lattice layers. For example, stabilization pieces 170 may be made from resin, filament, metal, nylon, plastic, rubber, wood, or other suitable materials. Stabilization pieces 170 should provide a final layer of stability (or "absolute stop") when the recoil generated by the firearm is sufficient that it creates too much force for the lattice layers to completely absorb the recoil without deformation, misalignment, or other undesired movement or compression.

Stabilization pieces 170 may form part of the exterior structure of the recoil pad 100 or they may be internal pieces such as metal rods placed to stop compression of the recoil pad 100 beyond a desired point (acting as a form of "bottoming out"). Stabilization pieces may also serve to redirect some of the recoil generated by the firearm. For example, a stabilization piece may be a rod with a wider base near the firearm and an angled top point of the rod which helps direct the generated recoil. Further, the redirection of recoil may be concentrated into specific portions of either or both lattice structures.

At least one of the lattice layers may require or benefit from an exterior support structure 180. This exterior support structure may provide a base and/or engage with at least one of the lattice layers to prevent deformation or undesired movement, compression, misalignment, etc. during the compression generated by the recoil produced by the firearm. Stabilization pieces 170 may be part of the exterior support structure 180.

Figure 3:
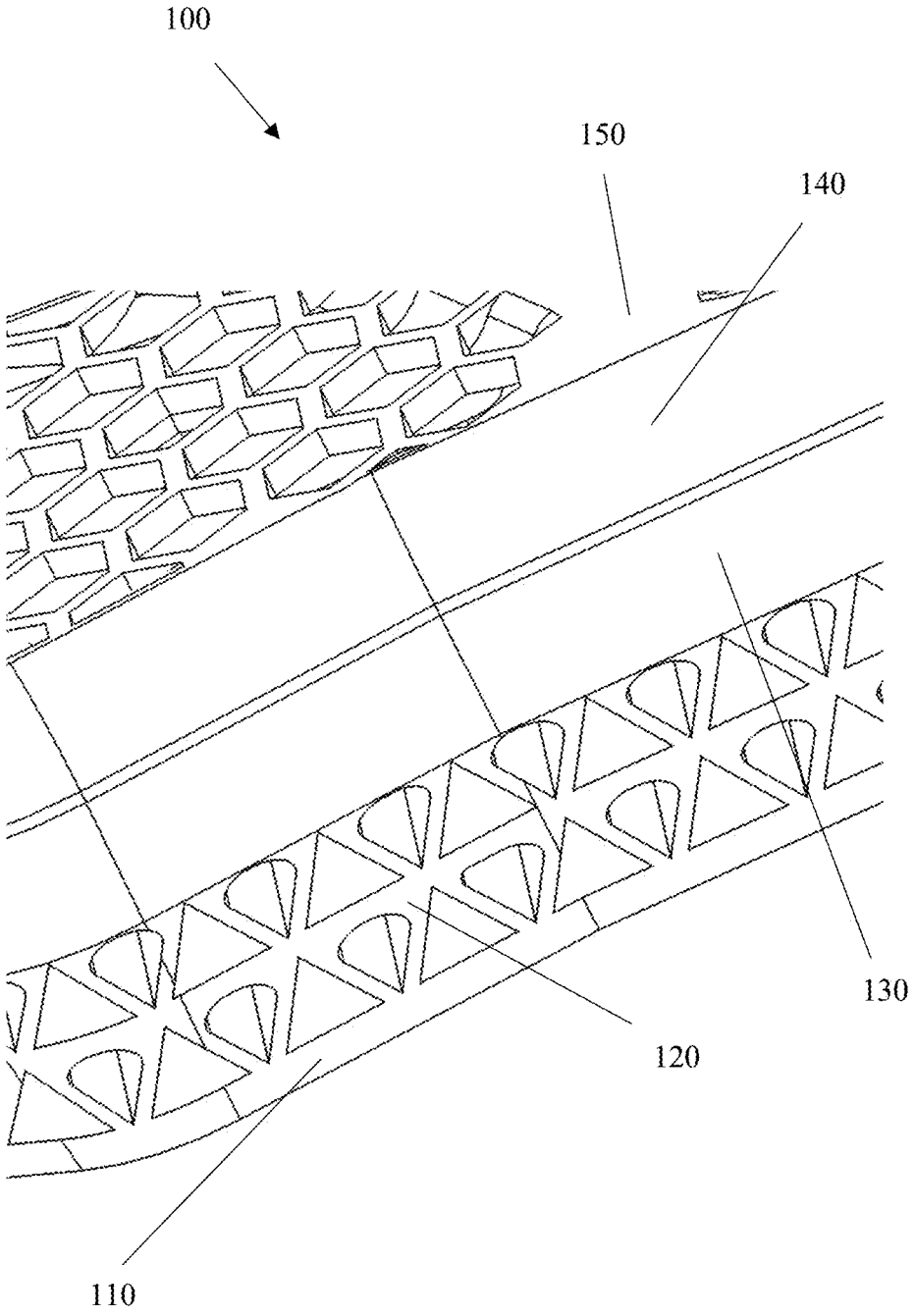
FIG. 3 depicts a close-up of a cross section of a first lattice layer comprised of a modified lattice structure featuring predominantly triangular shapes.

FIG. 3 depicts a close-up of a cross section of a first lattice layer comprised of a modified lattice structure featuring predominantly triangular shapes. In the depicted embodiment, the first lattice layer 120 features predominantly triangular shapes having rounded interior corners and/or intersections for some of the triangles. This lattice-like structure features additional stability and resistance against compression due to the support provided by the extra material in these rounded portions.

Other modifications to increase stability and resistance to compression may include: crossbars at the corners of the triangle or interwoven between triangles, stabilizing rods in the beams forming the triangles, a plurality of different shapes to create desired crush zones (wherein, generally, larger empty spaces are more likely to "crush" first), and so on.

Figure 4:
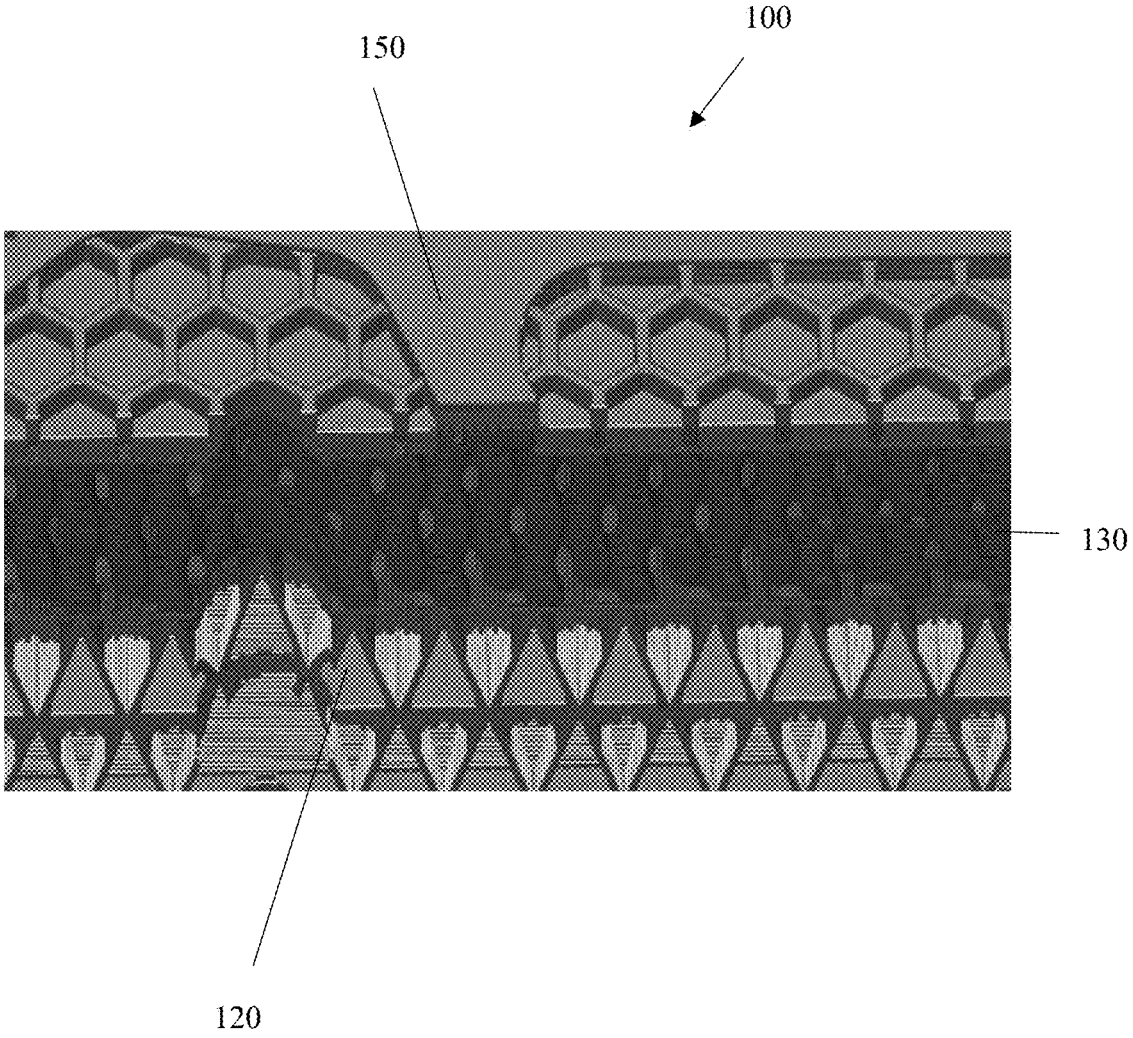
FIG. 4 depicts a cross section of an exemplary embodiment of a recoil pad having two distinct lattices.

FIG. 4 depicts a cross section of an exemplary embodiment of a recoil pad having two distinct lattices.

In some embodiments, the second lattice layer 130 of the recoil pad 100 may include gyroids to absorb a significant amount of the recoil generated by the firearm. In alternative embodiments, the second lattice layer 130 may be constructed as an isotropic layer. Whether an isotropic layer or a layer made of a gyroid structure, the layer ideally resists twisting, rotational, and/or directional forces from a plurality of directions either as direct force or force caused by the friction of the recoil pad 100 against the user and the user's clothing or other gear. This resistance improves the efficiency of the recoil pad 100 by supplying and/or reinforcing the other lattice layer(s) from prematurely deforming due to losing their support structure or base.

In one exemplary embodiment, the second lattice layer 130 comprised of gyroids is coupled with the first lattice layer 120 comprised of a primarily triangular lattice structure forming a crush zone for absorbing a portion of the recoil generated by the firearm. The combination of these two different styles of lattice structures creates a great impact on the recoil produced by the firearm than either lattice structure alone or in combination with a similar lattice structure (for example if there were two crush zone lattice structures or all gyroid lattice structures).

The gyroids used in the present invention may be created via manmade equation or generated by a computer based on given parameters and/or instructions from a user. One example gyroid surface equation usable with the present invention includes:

$$\cos(x)\sin(y)+\cos(y)\sin(z)+\cos(z)\sin(x)=0$$

If it is desired to have a computer generated gyroid structure via a specialized computer program or application (either from a design perspective or as a way to allow untrained users to design their own lattice structures), the user may enter desired parameters and properties including: the percentage volume to fill, density of structures, number and form of empty spaces, thickness of the walls of the structure, rotation of the gyroids within the structure, and more. For the purpose of generating a gyroid structure to be used as a lattice structure in a recoil pad, the user may input the desired the percentage volume for the program to fill into the space to be within the range of about 8% to about 40%. Those skilled in the art will appreciate that the more space that is filled, generally the heavier and stiffer the gyroid lattice structure becomes. Further, the design of the gyroid structure may create variable dissipation, redirection, and absorption (collectively considered to be "effects") of the force generated by the firearm's recoil and the corresponding felt recoil on the user.

The cross-section depicted in FIG. 4 prominently displays a corridor (or hole) that starts on the bottom layer 110, runs through the first lattice layer 120 and the second lattice layer 130, and has an additional hole leading out of the top layer 150. This structure is an exemplary firearm coupling means 160 that provides a way for a pin or screw to secure the recoil pad 100 to the firearm.

Figure 5:
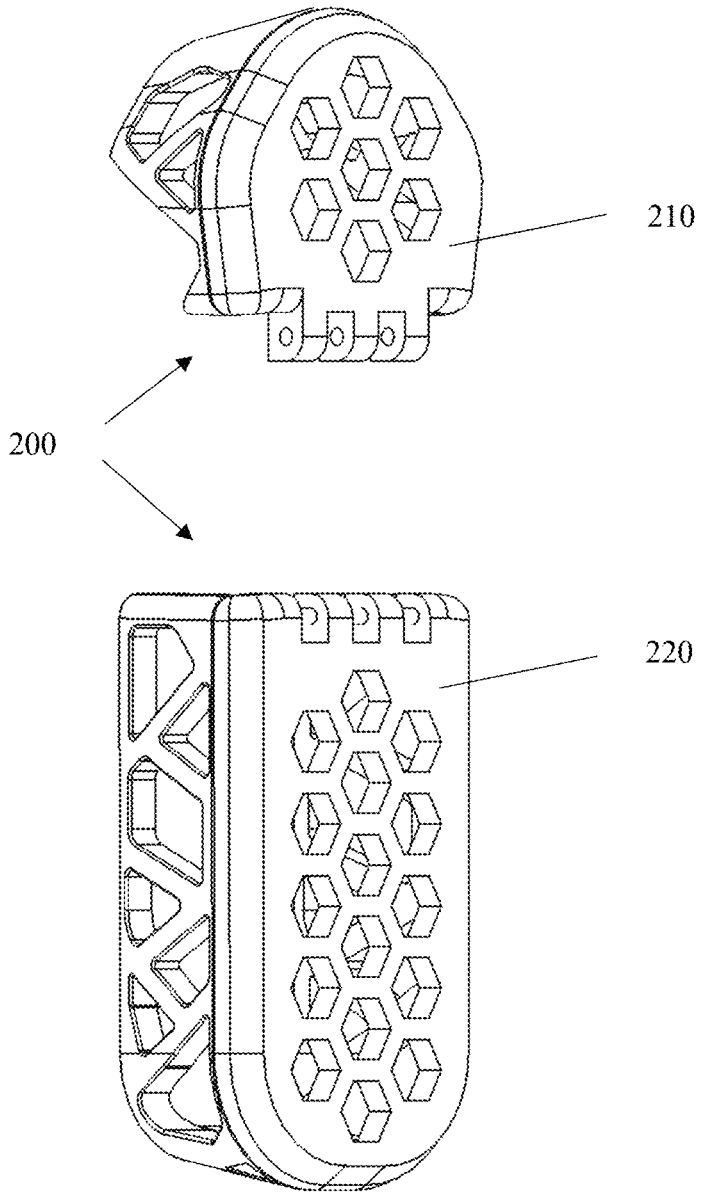
FIG. 5 depicts an angled view of an exemplary embodiment of an uncoupled protector for the recoil pad of FIGS. 1-4.

FIG. 5 depicts an angled view of an exemplary embodiment of an uncoupled protector for the recoil pad of FIGS. 1-4.

In some embodiments, a protector 200 is designed to form fit and/or be used with the recoil pad 100 of the present invention to allow for safe storage and transport of the recoil pad 100 while it is attached to the firearm. This removes the need for the user to constantly attach and detach the recoil pad 100 to prevent the recoil pad from becoming damaged, deformed, compressed, shifted, or otherwise negatively impacted while the firearm is not in use. The protector 200 may be made of the same or different materials than used to make the recoil pad 100 including metals, harder plastics, wood, and so on. It should be appreciated that the protector 200 should typically be made of sturdier materials that are more resistant to deformation, warping, etc. than the recoil pad 100 to ensure the protector 200 and the recoil pad 100. Further, the protector 200 allows for the manufacture, use, storage, and transport of a recoil pad that is made of easily compressed (or "squishy") material (such as the materials sometimes used in 3-D printing) without fear of that material deforming, irreversibly compressing over time, warping, becoming damaged, etc. These squishier versions of the recoil pad 100 having at least one specially designed lattice structure may prove to provide the best dissipation, redirection, slowing of recoil velocity, and absorption of the recoil generated by shooting the firearm. Likewise, the protector 200 may be designed to encase particularly squishy versions of the recoil pad 100 in such a way that little to no pressure is applied to the recoil pad 100 during storage and/or transport of the firearm coupled to the recoil pad 100. Put another way, the protector 200 may be designed to maximize the reduction of pressure applied to the recoil pad 100 during storage and/or transport of the firearm coupled to the recoil pad 100.

The embodiment depicted in FIG. 5 is a simpler version of the protector 200 having a hingedly connected upper portion 210 and lower portion 220. The design of the protector 200 may mirror or complement (either aesthetically or functionally or both) the design of the recoil pad 100. In some embodiments, the protector 200 may be designed to provide additional support to the user if the user discharges the firearm while having both the recoil pad 100 and protector 200 still coupled to the firearm. It should be appreciated that firing the firearm without removing the protector 200 will change, and possibly diminish, the value of the recoil absorption achieved by the recoil pad 100.

It is important that the design of the protector 200 allows the recoil pad 100 to rest without the threat of deformation, distortion, compression, or other force which may reduce the recoil pad's 100 effectiveness when the user discharges the firearm. The protector 200 further should be designed to remove the need for the user to uncouple the recoil pad 100 from the firearm during transport and/or storage.

The protector 200 may be custom made and/or form-fitted to the recoil pad 100 in order to maximize the protector's 200 effectiveness for its intended purpose. In some embodiments, the recoil pad 100 may have at least one side that is not parallel to the largest plane or frame of the firearm (such as a stock of a rifle) but rather "flares out." This protruding side may provide stopping means for the protector 200 to remain engaged to the recoil pad 100 by preventing it from being pulled off the recoil pad 100 prior to disengaging a locking mechanism and/or hinged connection on the protector 200. The protector 200 may not be able to be removed because of the flared sides of the pad, as well as an attachment plate or structure on the stock of the firearm, thus making it difficult to remove without disengaging the hinged connection and/or other securing mechanism of the protector 200. In this embodiment, the protector 200 may support the weight of the firearm between the protector 200 and the attachment plate 300 so that the recoil pad 100 has little to no pressure applied to it when the firearm is stored and/or transported. Further, this embodiment may keep a portion or all of the recoil pad 100 off the ground or other bottom plane during storage or transport of the present invention while engaged with the firearm. The protector 200 may be secured to the recoil pad 100 by sliding it onto the longest length of the recoil pad 100 and then closing the hinged portion of the protector 200.

Figure 6A:
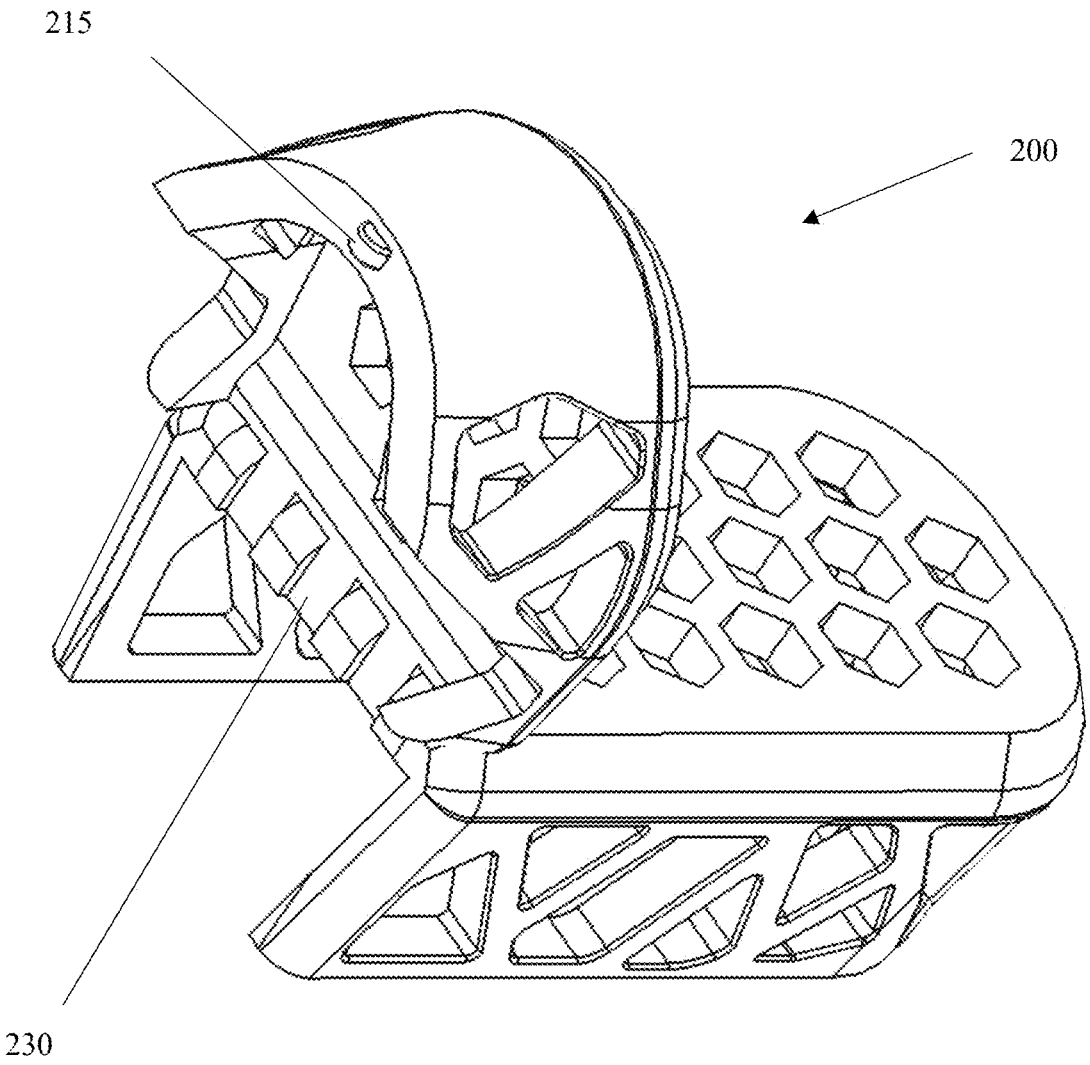
FIG. 6*a* depicts an isometric view of an exemplary embodiment of a coupled protector for the recoil pad of FIGS. 1-4 in an open position.

FIG. 6*a* depicts an isometric view of an exemplary embodiment of a coupled protector for the recoil pad of FIGS. 1-4 in an open position. This view prominently displays (in an open position) the inner portion of a hinged connection 230 that may be secured via common means including hole-and-pin (with or without a retainer or fastener) connectors, hinges with fasteners, grooved or slotted hinges, etc. Similar connections or couplings (pin connections for example) may be used to achieve the same purpose of securing the protector 200 to the recoil pad 100.

The protector 200 may further include a secondary structure 215 for engaging with the recoil pad 100, firearm, and/or attachment plate 300 when closing the protector 200. The secondary structure 215 may also aid the user in locking and unlocking the protector 200. Further, the protector 200 should resist any movement when engaged with any of the recoil pad 100, attachment plate 300, the firearm, and combinations thereof.

Figure 6B:
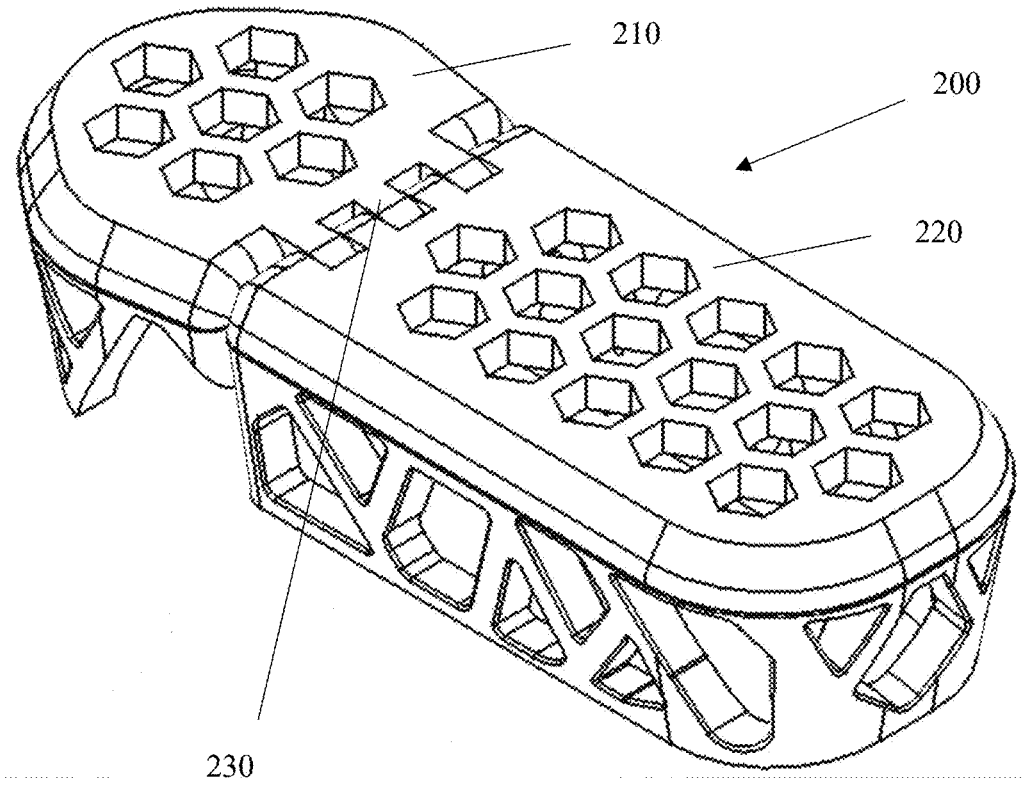
FIG. 6*b* depicts another isometric view of an exemplary embodiment of a coupled protector for the recoil pad of FIGS. 1-4 in a closed position.

FIG. 6*b* depicts another isometric view of an exemplary embodiment of a coupled protector for the recoil pad of FIGS. 1-4 in a closed position.

The depicted embodiment shows a flush back created by the protector 200 being in the closed position which makes it easier to store the rifle with the protector 200 contacting the floor or other surface. The protector 200, in ideal embodiments, includes a locking mechanism so that the protector 200 does not undesirably become removed from the recoil pad 100 while the protector 200 is in the closed position.

Figure 7:
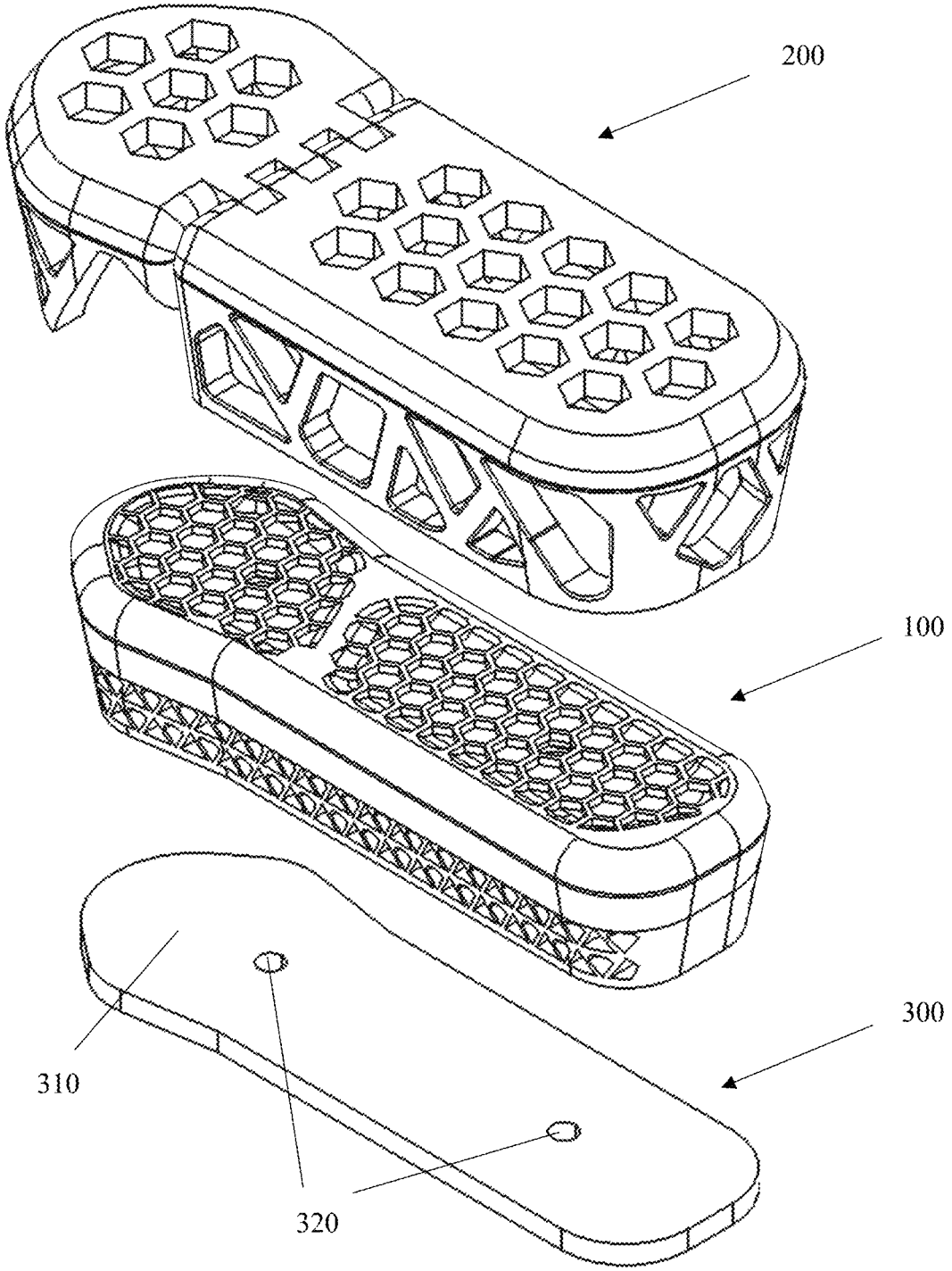
FIG. 7 depicts an isometric view of an exemplary embodiment of the present invention including a recoil pad having two distinct lattice layers, a protector for the recoil pad, and an attachment plate.

FIG. 7 depicts an isometric view of an exemplary embodiment of the present invention including a recoil pad having two distinct lattices, a protector for the recoil pad, and an attachment plate.

The present invention, in some embodiments, includes a recoil pad assembly including the recoil pad 100, the protector 200, and an attachment plate 300. In ideal embodiments, the recoil pad 100, the protector 200, and the attachment plate 300 have been designed to fit the specific firearm of the user's choosing. In alternative embodiments, the attachment plate 300 may serve as means for attaching the recoil pad 100 to a variety of firearms. In alternative embodiments, the recoil pad assembly may include a recoil pad 100 with a firearm coupling means 160, with or without an attachment plate 300 and/or protector 200. The recoil pad assembly at its most basic embodiment is merely the recoil pad 100 and the firearm coupling means 160.

The attachment plate 300 may include a coupling means 320 similar to the recoil pad's 100 firearm coupling means 160 such as holes for screws similar to the recoil pad's 100. The attachment plate 300 does not need to have the same coupling mechanism as the recoil pad 100 and may be fastened with mechanical, adhesive, hook-and-loop, or other coupling methods. Further, in some embodiments, the attachment plate 300 may serve as an intermediary to attach to the firearm when the design of the firearm would make it difficult for the recoil pad 100 to directly attach to the firearm.

The attachment plate 300 may be included in the assembly but ultimately not used to connect the recoil pad 100 to the firearm. The attachment plate should provide additional securement, stability, durability, and/or recoil absorption for the recoil pad 100 when coupling the recoil pad 100 to the firearm.

In some embodiments, the recoil pad 100, including the lattice structures of the first lattice layer 120 and the second lattice layer 130, is designed and constructed specifically for the type of firearm to which the recoil pad 100 is attached. In further embodiments, the lattice structures are designed and constructed to absorb, dissipate, redistribute, delay, redirect, slow the velocity of, and/or otherwise effect (collectively, but not exclusively, "effect") the felt recoil of not only the type of firearm but the specific firearm (make, model, version, etc.) that the user operates. In even further embodiments, the lattice structures are designed and constructed to absorb the recoil of that firearm and the type of ammunition that the user shoots. All of these designs and constructions are generally for the purpose of optimizing the dissipation, redirection, slowing of recoil velocity, and absorption of the recoil generated by shooting the firearm. Optimization may mean overall reduction of felt recoil, focusing reduction effects on the firearm to improve accuracy, focusing on reducing the velocity of the force the recoil places on the user, reducing the strain that the recoil places on the firearm, improving the user's ability to maintain a clear view through a scope or sights during and after the firearm's recoil sequence, providing a material with sufficient stiffness to firmly mount to the user's shoulder as well as having a sufficiently grippy surface to keep the firearm and recoil pad 100 from slipping during the firearm's recoil sequence, or other purposes for optimization of recoil dissipation, redirection, and absorption.

In some embodiments, the protector is designed to engage with the attachment plate which intermediates the connection between the recoil pad and the firearm, and wherein the encasement for the recoil pad created by the attachment plate and the protector is designed to maximize the reduction of pressure exerted on the recoil pad when the firearm that the recoil pad is coupled to is stored and transported.

In some embodiments, the present invention may include a method wherein the user supplies a manufacturer with at least two specifications for the firearm (including the make and model) and/or the ammunition that the user shoots. These specifications may include data and information including the firearm's weight, the cartridge or shell size and type, the selected load, and whether the firearm is fitted with another apparatus which may or may not have an effect on the generated recoil of discharging the firearm such as a silencer or muzzle brake. The manufacturer, in some embodiments of a method for creating a custom recoil pad assembly, may use the specifications for the firearm and related data points, provided by the user, to either match or create a suitable recoil pad (with or without an assembly and/or protector). Likewise, the manufacturer may further design and construct a recoil pad with or without a protector to be used with the user's firearm and ammunition. When designing such a recoil pad, the manufacturer may enter in the specifications of the firearm and ammunition to have a computer program or application design at least one gyroid structure that is specialized in reducing the felt recoil generated by that firearm and ammunition. This is a necessary calculation and optimization for the present invention's effectiveness because some firearms are capable of firing different types of ammunition and not all ammunition of a specific type may generate the same amount of force created by shooting the firearm due to the ammunition's material (lead, steel, copper, brass, aluminum, etc.), amount of combustible material, type of combustible material, length of the shell, etc.

The recoil pad assembly may be constructed through various means such as traditional manufacturing (such as injection mold processing) or 3-D printing (including stereolithography, selective laser sintering, fdm, sla, multi jet fusion, PolyJet, etc.). 3-D printing is particularly adept for constructing the gyroid structures of the present invention.

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods, systems, and apparatus described herein may be accomplished by appropriate modifications by one of ordinary skill in the art without departing from the scope of the present invention. Several such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A recoil pad assembly for a firearm comprising:

a recoil pad comprising:

a bottom layer that engages with the firearm to secure the recoil pad to the firearm via a firearm coupling means;

at least two lattice layers comprising:

a first lattice layer connected to the bottom layer and comprising a first lattice structure comprising a predominantly triangular crush zone;

a second lattice layer connected to the first lattice layer and comprising a gyroid structure that is computer-engineered and 3-D printed for absorbing the recoil produced by a firearm;

wherein the second lattice layer serves as a final lattice layer and is furthest from the firearm;

a top layer connected to the final lattice layer;

wherein the at least two lattice layers are designed and constructed to dissipate, redirect, absorb, and effect the felt recoil generated by the firearm when a user shoots the firearm; and the firearm coupling means for attaching the recoil pad to the firearm.

2. The recoil pad assembly of claim 1, further comprising an attachment plate designed to secure the recoil pad to the firearm via a coupling means.

3. The recoil pad assembly of claim 2, wherein the first lattice layer is designed to absorb one section of a recoil pattern on a recoil graph and the second lattice layer is designed to absorb another section of the recoil pattern on the recoil graph for the firearm's recoil produced by discharging the firearm.

4. The recoil pad assembly of claim 1, wherein the gyroid structure is generated by a computer program based on the parameters and properties of the model of the firearm and the firearm's recoil graph.

5. The recoil pad assembly of claim 1, wherein the gyroid structure fills between 8% to 40% of the volume of the space of the lattice layer comprised of material forming the gyroid structure.

6. The recoil pad assembly of claim 1, wherein the gyroid structure consists of a structure which repeats itself from between every 1.5 mm to every 1.7 mm.

7. The recoil pad assembly of claim 1, wherein the at least two lattice layers have wall thicknesses between 0.2 mm to 2 mm.

8. The recoil pad assembly of claim 1, wherein at least one intermediate layer separates at least two of the at least two lattice layers.

9. The recoil pad assembly of claim 1, wherein the recoil pad and the at least two lattice layers are designed and constructed to optimize the reduction of felt recoil on the user produced by firing the firearm for a make and a model of the firearm.

10. The recoil pad assembly of claim 9, wherein the recoil pad and the at least two lattice layers are designed and constructed to optimize the reduction of felt recoil on the user produced by firing the firearm for a type of ammunition used with the firearm.

11. The recoil pad assembly of claim 1, further comprising an exterior support structure on the recoil pad which surrounds and supports at least one of the lattice layers of the recoil pad and a stabilizing covering on the recoil pad which provides support to the recoil pad and aids in effecting the recoil felt by the user.

12. The recoil pad assembly of claim 1, further comprising at least one stabilization piece in the recoil pad to aid in the dissipation, redirection, and absorption of the recoil generated by the firearm while also providing structural support to at least one of the lattice layers and serving as an absolute stop for the recoil to prevent damage to the recoil pad during use of the firearm.

13. The recoil pad assembly of claim 1, wherein at least one of the at least two lattice layers include a modified lattice structure that is designed to fit within the parameters of its layer within the design of the recoil pad and wherein the modified lattice structure includes modifications to improve the dissipation, redirection, slowing of recoil velocity, and absorption of the recoil generated by shooting the firearm.

14. The recoil pad assembly of claim 1, further comprising a protector for the recoil pad and wherein the protect is designed to form fit the recoil pad to protect the recoil pad from deformation, misalignment, warping, undesired compression, and damage while the firearm and recoil pad are coupled while being transported and stored without removing the recoil pad from the firearm.

15. The recoil pad assembly of claim 14, wherein the protector is designed to be capable of remaining engaged on the recoil pad while the user shoots the firearm.

16. The recoil pad assembly of claim 15, wherein the protector features a hingedly connected upper portion coupled to a lower portion to create a hinged connection having an open position and a closed position and including a locking mechanism which must be disengaged to remove the protector from the recoil pad assembly.

17. A recoil pad assembly for a firearm comprising:

a recoil pad comprising:

a bottom layer that engages with the firearm to secure the recoil pad to the firearm via a firearm coupling means;

at least two lattice layers comprising:

a first lattice layer connected to the bottom layer and comprising a first lattice structure comprising a predominantly triangular crush zone;

a second lattice layer connected to the first lattice layer and comprising a gyroid structure that is computer-engineered and 3-D printed for absorbing the recoil produced by a firearm;

wherein at least one additional lattice layer serves as a final lattice layer and is furthest from the firearm;

a top layer connected to the final lattice layer;

wherein the at least two lattice layers are designed and constructed to dissipate, redirect, absorb, and effect the felt recoil generated by the firearm when a user shoots the firearm; and the firearm coupling means for attaching the recoil pad to the firearm.

18. The recoil pad assembly of claim 17, further comprising at least one intermediate layer between lattice layers for each lattice layer that is adjacent in sequence to another lattice layer.

* * * * *